US007344389B2

(12) United States Patent
Kramski

(10) Patent No.: US 7,344,389 B2
(45) Date of Patent: Mar. 18, 2008

(54) CONTACT PIN AND METHOD FOR THE PRODUCTION THEREOF

(75) Inventor: Wiestaw Kramski, Birkenfeld (DE)

(73) Assignee: Kramski GmbH, Pforzheim (DE)

( * ) Notice: Subject to any disclaimer, the term of this patent is extended or adjusted under 35 U.S.C. 154(b) by 0 days.

(21) Appl. No.: 11/716,714

(22) Filed: Mar. 12, 2007

(65) Prior Publication Data

US 2007/0212907 A1 Sep. 13, 2007

(30) Foreign Application Priority Data

Mar. 12, 2006 (DE) ..... 10 2006 011 657

(51) Int. Cl.
*H01R 12/00* (2006.01)

(52) U.S. Cl. ..... 439/82

(58) Field of Classification Search ..... 439/78–82
See application file for complete search history.

(56) References Cited

U.S. PATENT DOCUMENTS

| | | | |
|---|---|---|---|
| 3,400,358 | A | 9/1968 | Byrnes et al. |
| 4,923,414 | A | 5/1990 | Sitzler |
| 6,135,813 | A | 10/2000 | Philippe |

FOREIGN PATENT DOCUMENTS

| | | |
|---|---|---|
| DE | 37 84 911 | 6/1993 |
| DE | 195 08 133 | 9/1996 |
| DE | 198 31 672 | 2/2000 |
| DE | 10 2004 028 202 | 12/2005 |
| EP | 0 387 317 | 9/1990 |
| EP | 0 655 798 A2 | 5/1995 |
| JP | 03-017971 | 1/1991 |

*Primary Examiner*—Khiem Nguyen
(74) *Attorney, Agent, or Firm*—Rabin & Berdo, PC

(57) ABSTRACT

A contact pin for pressing into a through-connected hole of a printed circuit board is produced by forming. Its press-in portion has two contact legs spaced apart from one another by an elongate opening, are outwardly curved in their central region and, when pressed into the circuit board come to rest with plastic deformation on the wall of the hole. A portion for introduction into the hole includes at least two elongate portions resting on one another during introduction. These portions, after forming and before introduction into the hole adjoin the outwardly open elongate opening like fork prongs. As a formation projects into the opening at an edge thereof to form support regions which, after introduction of the contact pin into the hole, are located inside the hole, a contact pin and a method for the production thereof are provided, by punching in conformity with standards, with optimum extraction forces.

18 Claims, 4 Drawing Sheets

CONTACT PIN AND METHOD FOR THE PRODUCTION THEREOF

REFERENCE TO RELATED APPLICATIONS

Figure 1:
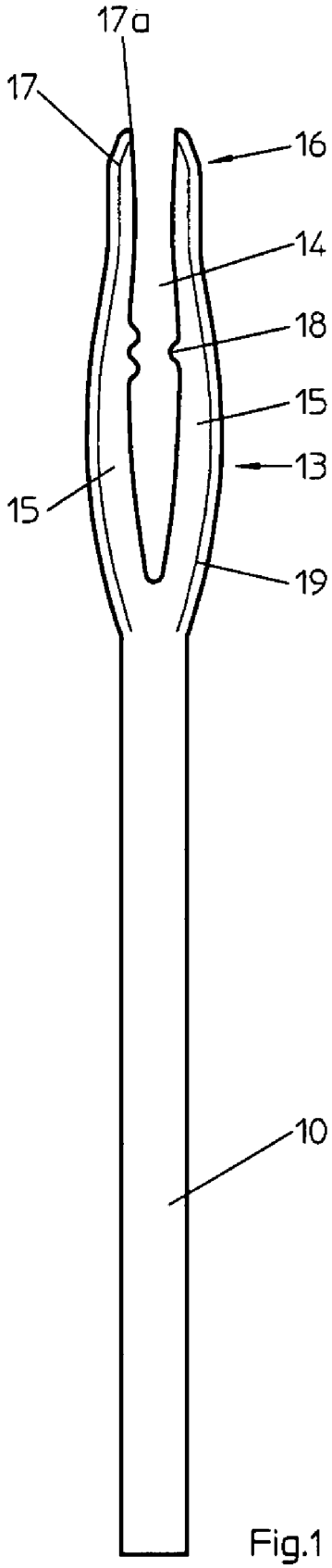

The present application claims the priority of the German patent application 10 2006 011 657.7, filed on 12 Mar. 2006, the disclosure content of which is expressly also made the subject of the present application.

1. Field of the Invention

The invention relates to a contact pin with a contact region and a connection region for pressing into a through-connected hole of a printed circuit board according to the preamble of claim 1 and a method for the production thereof according to the preamble of claim 12.

2. Prior Art

Contact pins of this type are provided, in particular, for producing a solder-free, electrically conductive connection to at least one conductor track of the printed circuit board by pressing into metalized punchings of electric printed circuit boards. For perfect contacting of the punching, the manufacturing tolerances thereof have to be compensated by corresponding configurations of the press-in portion of the contact pin, so a preferably gas-tight connection is ensured between the punching and press-in portion. For this purpose, the press-in portions of contact pins of this type can be plastically deformed, on the one hand, against corresponding force, and, on the other hand, corresponding demands are made of the elastic properties after introduction, with respect to the extraction forces. These properties are realized, for example, in that an elongate hole formed in the manner of a needle eye is punched into the contact pin in the press-in portion, so that two contact legs are formed which can be moved toward one another in a spring-elastic manner.

The connection produced by the contact pin or press-in pin has to satisfy various electrical and mechanical demands and must pass extensive tests. The most important properties of this connection are:

low contact resistance
no contact corrosion,
optimum press-in forces,
optimum extraction forces,
thermal stability,
vibration stability,
preferably no swarf formation when pressing in.

This property profile is achieved by contact pins or press-in pins, which have an elastic-plastic region to, on the one hand, bridge the hole tolerances of the circuit-boards, and, on the other hand, to ensure the desired press-in and press-out forces and the contacting.

From DE 10 2004 028 202 A1, on which the preamble of claim 1 is based, a press-in contact is known, which is produced without swarf from a material with the formation of two portions which are spaced apart from one another and initially open if necessary, which later, in abutment with one another, form the introduction pin. The cross-sectional shape of the portions is selected such that they brace at points with the walls in the hole of a printed circuit board, which can lead to tin abrasion and stressing of the hole edge. The aim is a press-in contacting generated there without swarf, the hole cross-section being virtually completely filled by a cross-sectional shape approximating a square. Above all, with a reducing sheet thickness (less than 0.8 mm, for example) and a smaller hole diameter, ever lower clamping forces are produced, so that a permanently reliable electrical connection is at risk.

U.S. Pat. No. 6,135,813 A shows an introduction pin, which, at its leading end, has two virtually inversely symmetrical formations, which come to rest outside the hole in the state in which they are introduced into the printed circuit board. Projections which project outwardly from the pin diameter anchor the pin after guiding the pin through the hole of the printed circuit board, while the formations which project inwardly do not brace with one another and do not change in any manner at all, but if necessary are soldered together with one another in their position and are therefore secured. They do not therefore influence the behavior in the hole of the printed circuit board.

A contact pin is known from EP 0 655 798 A2, which is punched out of a material and, before the production of the contact element, has two portions which are spaced apart from one another, which later form the introduction pin. An opening in the shape of a needle eye is provided in each of the portions. By turning over, the two portions are placed against one another, the two ends of these portions are placed against one another owing to corresponding prior deformation, so that the introduction pin is produced, which can then be introduced into a through-connected hole of a printed circuit board. The free ends are not connected to one another, however.

Another contact pin is known from U.S. Pat. No. 3,400,358, in which a pair of outwardly curved cables are soldered together at their ends to form the introduction pin. The surfaces of the cables, which point toward one another can be flattened at their ends to facilitate the solder connection. This production process is expensive and not solder-free.

Contact pins of this type are generally produced by punching the contact pins with the introduction of central longitudinal slots, which allow the elastic behavior, as known, for example, from DE 195 08 133 C2 or DE 198 31 672 B4. In this case, with dimensions of the contact pins becoming smaller and smaller and tolerances of the punching of the printed circuit boards becoming larger and larger, a smaller and smaller tolerance of the connection is required. The central slot, based on the demands of the plugging and pulling forces, is optimized, the manufacturing technology in the punching, for example as a result of the punch stability, reaching its limits. In the current punching technology, the inner shape of the elongate hole is limited to a certain size by punching and cutting forces, as it cannot otherwise be produced. Consequently a compromise is obtained, which, in the region of the pin or introduction region, which has the first contact with the printed circuit board during assembly, leads to a zone which is hardly, or not elastic, as a tapering edge of the opening can hardly be produced in this region, for example by punching. This can introduce abrasions of the surface, which, as swarf, can produce short circuits. As the diameter tolerance of the punchings of the printed circuit boards, which is covered by a press-in portion, seldom corresponds to the standard, corresponding contact pins only with restricted tolerances of the circuit board hole diameters are used.

Contact pins with embossed zones are also known, for example, from JP 03 017971 A or U.S. Pat. No. 4,923,414 A, wherein, in this case, the press-in portion is generally formed such that it can plastically deform during pressing in. These contact pins generally do not cover the region in conformity with the standard, either. In addition, manufacture is very tolerance-sensitive and the risk of abrasions is relatively high.

In order to improve the properties and, in particular, the extraction forces, it has already been attempted many times to provide formations in the region of the longitudinal slot between the contact legs of the press-in portion, which formations overlap when pressed into the punching of the printed circuit board, for example (cf. DE 37 84 911 T2) or to provide this region with formations, which come into contract with one another during deformation (cf. EP 0 387 317 B1). The limits of this configuration are again the limits of punching technology, as contact pins with a further miniaturization can hardly still be produced by punching.

OBJECT OF THE INVENTION

Proceeding from this prior art, the present invention is based on the object of providing a contact pin and a method for the production thereof, which can be produced by punching in conformity with standards, with optimum extraction forces.

This object is achieved by a contact pin with the features of claim 1 and by a method with the features of claim 12.

The contact pin has an open shape, in which, after the punching process, the elongate opening forming the later slot is open to the outside and lies between the portions, which later form the introduction portion of the contact pin. With the therefore initially open, fork prong-like shape of these portions, which then rest on one another during introduction into the hole, the limitations of the punching technology can be avoided. At the same time, each basic shape of a contact pin can be produced so as to be larger or smaller without problems, i.e. the press-in and press-out forces can be better defined and are softer or harder, for example, in the transition regions, which is not possible in current punching technology with a closed needle eye. Any geometric formations are formed inside the elongate opening to thus form support regions, for example. These support regions can control the elastic-plastic behavior by means of the different hole diameters. In addition, the formations may preferably come to rest in the hole itself. However, they can also lead to a type of tilting movement, which allows the region overlaid by the hole to become wider than the press-in region, which leads to increased press-out forces. Good clamping forces can consequently still be produced even with a reducing sheet thickness and a smaller hole diameter. Tests have shown that even with small bore diameters of 1.0 mm and sheet thicknesses of 0.6 mm a reliable connection can still be produced.

The formations or support areas preferably produced by machining or forming are no longer produced resting on one another with increasing miniaturization of the contact pins. Instead, an opening is initially punched out in order to expose the formations there. The press-in region of the contact pin is accordingly produced as an open fork, so the production technology limitations are dispensed with. The contact pin can preferably be closed at the end of the punching process or rather forming process, by welding, riveting, laser welding or the like, so the elongate opening or the slot is then preferably formed in the centre. The slot, for example, can therefore be formed so as to taper in the leading region in the introduction direction, so less material is present there; which is in the way of an elastic deformation during introduction of the press-in portion.

Further advantages emerge from the sub-claims and the following description.

SHORT DESCRIPTION OF THE FIGURES

Figure 2:
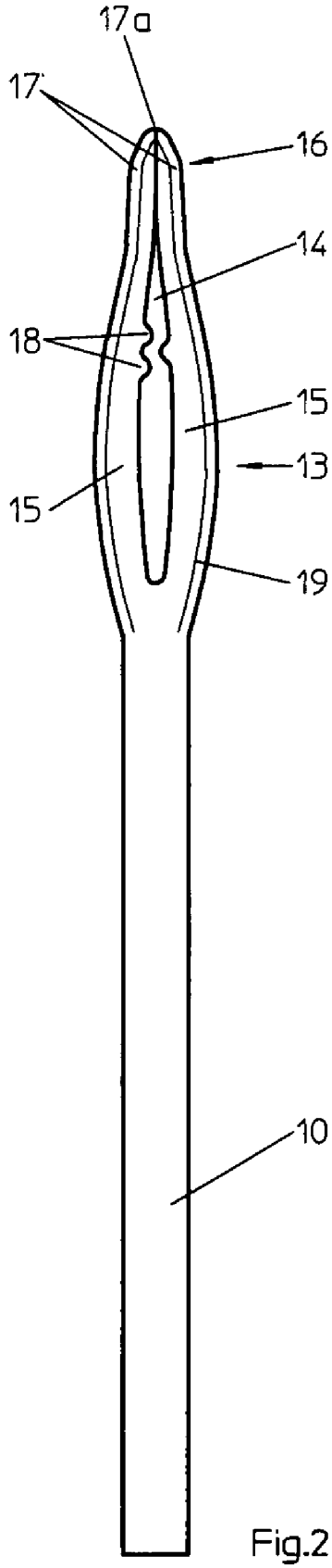
Figure 3:
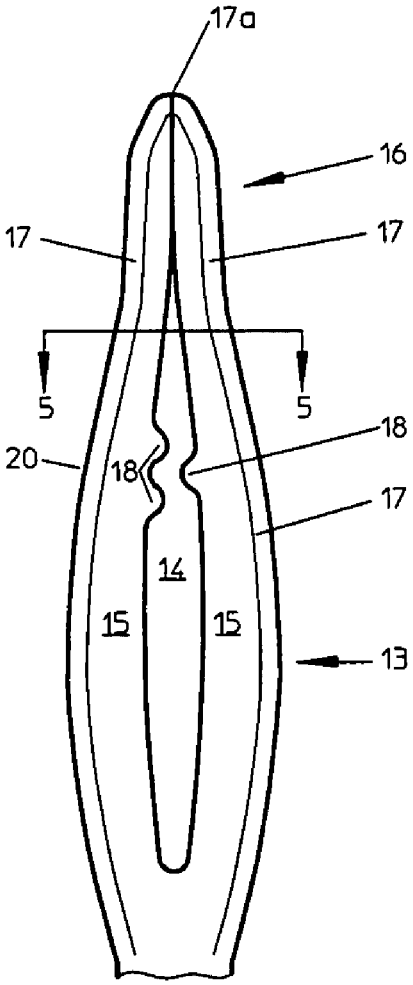
Figure 4:
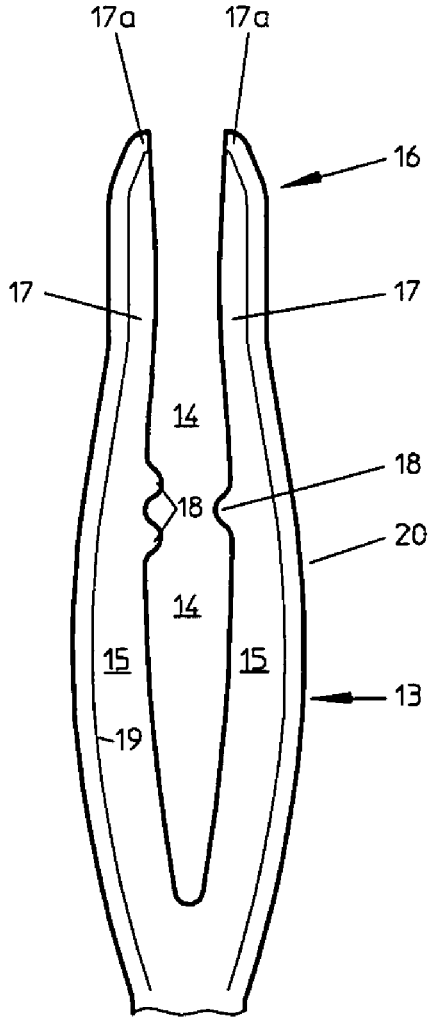
Figure 5:
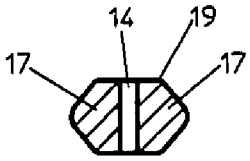
Figure 6:
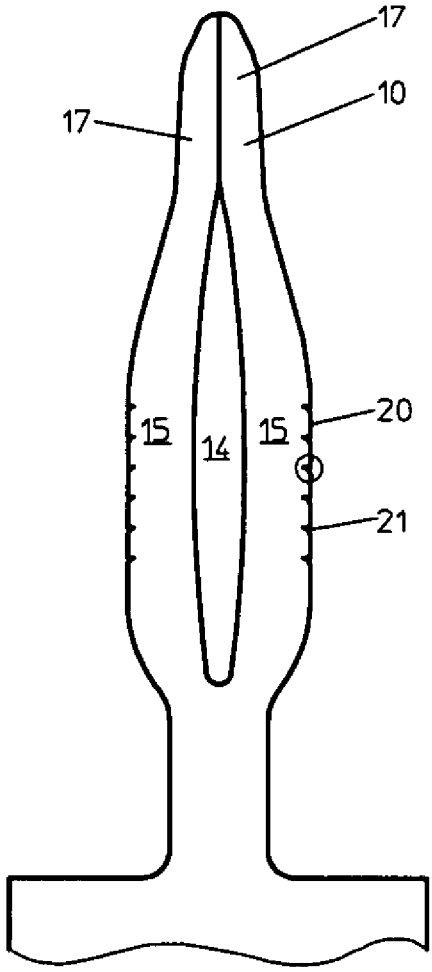
Figure 7:
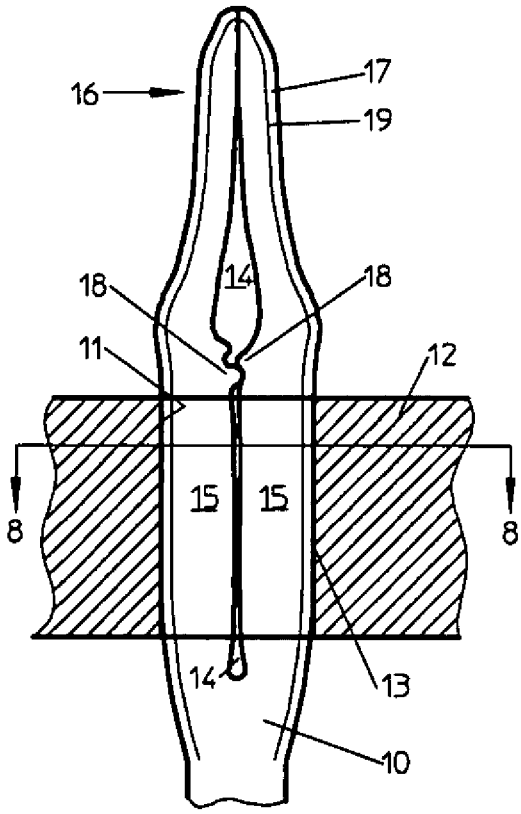
Figure 9:
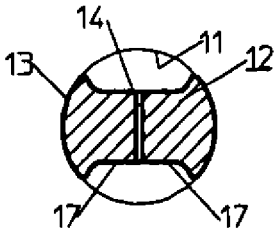
Figure 8:
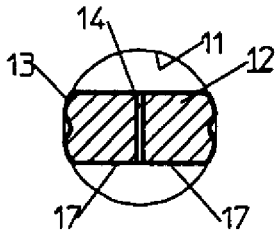
Figure 11:
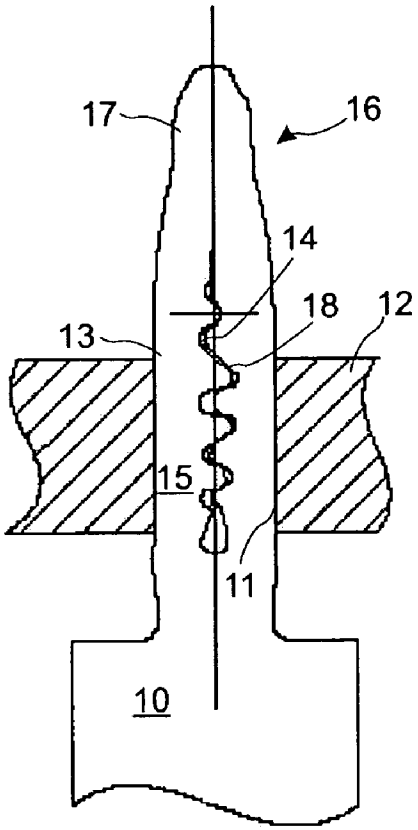
Figure 10:
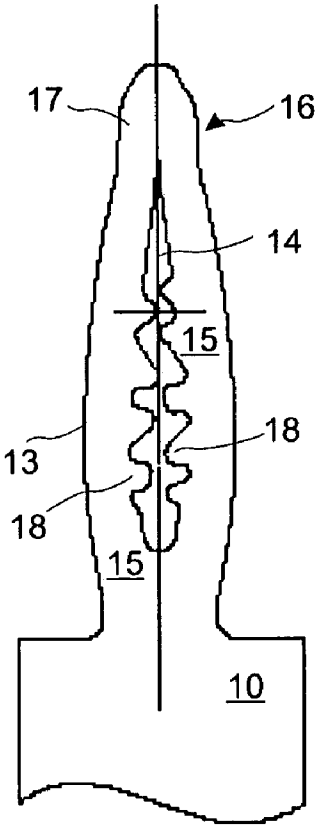

The invention will be described in more detail below with the aid of the accompanying drawings, in which:

FIG. 1, 2 show a view of a contact pin in the punched, open state and in a state in which the ends of the contact pin are connected to one another, FIG. 3 shows an enlarged view of the leading region of the contact pin according to FIG. 2, FIG. 4 shows an enlarged view of the contact pin according to FIG. 1, FIG. 5 shows a section along the line 5-5 of FIG. 3, FIG. 6 shows a contact pin with notched outer edges in a further embodiment, FIG. 7 shows the contact pin according to FIGS. 1 to 5 in a state introduced in the hole of a printed circuit board, FIG. 8 shows a section along the line 8-8 of FIG. 7, FIG. 9 shows a view which is analogous to FIG. 8 with a variant of the product contour, FIG. 10 shows a further embodiment of a contact pin with formations in the needle eye, FIG. 11, 12 show the contact pin of FIG. 10 as placed in circuit board holes of different diameter.

DETAILED DESCRIPTION OF THE PREFERRED EMBODIMENTS

The invention will now be described in more detail by way of example with reference to the accompanying drawings. However, the embodiments are only examples, which are not intended to restrict the inventive concept to a specific arrangement. Before the invention is described in detail, reference is made to the fact that it is not limited to the respective components of the device or the described procedure, as these components and methods may vary. The terms used here are only intended to describe special embodiments and are not used in a restrictive manner. If, in the description and in the claims, the singular or indefinite article is used, these also refer to the plurality of these elements, as long as the overall context does not unambiguously make clear something else. The same applies in the reverse direction.

The Figures show a contact pin 10 from a formed material for pressing into a through-connected hole 11 on a printed circuit board 12, which is shown in FIG. 7. When a forming or forming process is referred to below, this is taken to mean inter alia punching, cold extrusion, cold deformation or the like, but other deformation possibilities are basically also provided if this permits forming, which allows the production of an at least initially open opening framed by portions of the contact pin.

According to FIGS. 1 to 4, the contact pin has a press-in portion 13, which has at least two contact legs 15 which are spaced apart from one another by at least one elongate opening 14 and are outwardly curved in their central region. This press-in region, when pressed in according to FIG. 7, arrives in the hole 11 of a printed circuit board 12, wherein it plastically deforms there and therefore ensures the desired contacting with the printed circuit board. This contacting is intended to satisfy a plurality of demands, which are substantially that a low transition resistance is ensured, no contact corrosion occurs, minimum press-in forces and maximum extraction forces are present, thermal stability is ensured, and preferably no swarf production arises during assembly. The demands of the thermal stability, in particular, continue to increase and the connections thus provided are intended to be permanent, in particular, in the automotive sector, even in the event of relatively large vibrations. If it is also considered that the diameter of the holes of the printed circuit boards have a relatively large tolerance, while a low tolerance is demanded of the contact pins and the contacting, it becomes clear what dimensioning limits emerge in the production of contact pins of this type, in particular when they are to be produced by forming processes such as a punching process and this with increasingly small dimensions.

The contact pin 10 also has an introduction portion 16 for introduction into the hole 11, which according to FIGS. 2 and 3 is formed by at least two elongate portions 17 of the contact pin which rest against one another during introduction. The at least two portions 17, which, proceeding from a material bridge located on the rear end of the elongate opening 14 in the introduction direction, frame this opening, according to FIGS. 1 and 4, after the forming process, adjoin the outwardly open, elongate opening 14 in the manner of fork prongs. This open shaping therefore provides a new design freedom for the elongate opening. To this extent, only a few examples of the design of this opening are disclosed below and do not further restrict the invention.

The portions 17 are preferably arranged substantially approximately parallel to one another, however, only the configuration of the outwardly open elongate opening 14 between them is important. If necessary, they can be connected to one another at their ends 17*a* to form a pin enclosing the elongate opening 14. Such a connection need not actually be implemented at the last point of the end 17*a*, but rather the person skilled in the art will select this connection point in such a way that both suitable introduction and correspondingly high extraction forces are ensured. The connection may be a mechanical connection; common shaping with a positive fit, or a weld connection, such as, for example, laser welding, would be conceivable, but other connection possibilities, such as, for example, a riveting process, are also conceivable.

It becomes clear from the Figures that the portions 17, which, to be precise, form the prongs of a fork, form both the contact legs 15 of the press-in portion 13 and also the introduction portion 16 formed as a pin. Basically, more than two portions 17 may also be provided. In the closed state, it is thus possible, inter alia, to allow the elongate opening 14 to taper in the introduction direction. Thus, the prerequisite exists in this region, which is important for the introduction movement and is initially elastically deformed, that material should not be unnecessarily present there, which impedes precisely this introduction movement if plastic deformation occurs too early.

Formations 18 projecting into the opening are provided at the edge of the elongate opening 14, which formations come into operative connection with one another during the plastic deformation of the contact pin 10. Basically, these formations can be shaped in any manner and these formations in a configuration according to FIGS. 3, 4 and 7 are approximately inversely symmetrical and engage with one another during the plastic deformation, in which it is also possible to refer to a positive engagement. These formations 18, on the one hand, have the function of controlling the elastic-plastic behavior in the hole 11 by means of different hole diameters. The formations, which can also be called a support element or spigot, are provided to allow better introduction of the contact and are therefore preferably located in a region, which after introduction of the contact pin, is located inside the hole 11 of the printed circuit board in the embodiment according to FIGS. 10 to 12. On the other hand, as emerges from FIG. 7, for example, they can also contribute to a type of tilting movement in the overlaid region located on the other side of the hole, which allows this region to become wider than the pressing region located in the hole 11. This leads to increased press-out forces.

Figure 12:
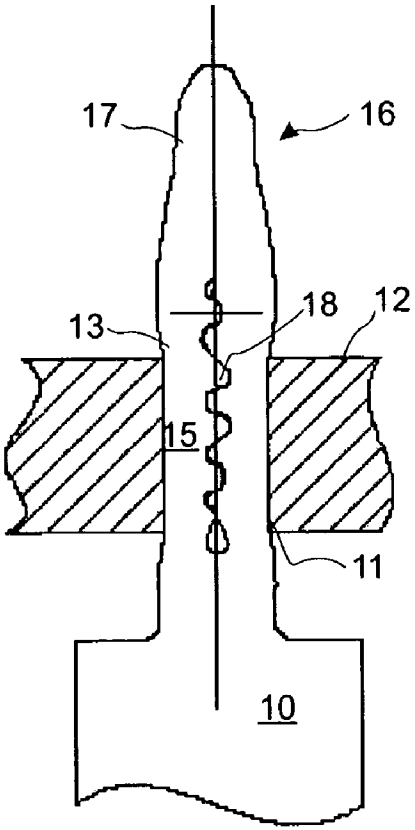

In the embodiment of FIGS. 11 and 12, when the elongate opening 14 is closed, the formations 18 are located in the opening 14 in the introduction direction such that they come to rest in the hole 11 in the inserted state and increase the extraction forces there without contributing to increased swarf production during introduction. This leads to the arrangement shown in FIGS. 11 and 12 after the introduction of the contact pin 10 into the hole 11. Other arrangements and configurations of the formations 18 are possible, however, for example in the leading third of the opening 14, so they are pushed over the hole 11 on introduction. According to FIGS. 11 and 12 the formations are effective with different diameters of the circuit board hole. FIG. 11 shows the contact pin within a hole with a diameter of for example 1.09 mm, while FIG. 12 shows the contact pin in a hole with a diameter of 0.94 mm. In both cases the formations 18 provide sufficient holding forces.

According to FIG. 5 in conjunction with FIG. 8 or 9, the portions 17 may have an edge- or bead-embossing. This embossing may be a variably running embossing 19, so the press-in forces and press-out forces can also be influenced by the embossing. The cross-section of the portions 17 preferably increase from the introduction portion 16 to the press-in portion 13. The contour of the embossing can be influenced in order to obtain a better engagement or contact face.

The ends 17*a* of the portions 17 are pointed and rounded at their outer edges 20, which are usually directed away from one another, to form an introduction pin. The portions are preferably arranged symmetrically to a centre line placed through the elongate opening 14 at least in the region of the introduction portion 16. Other, even non-symmetrical configurations are also possible here as the person skilled in the art may design both the elongate opening 14 and the portions 17 as required for each respective purpose of use, as long as an open shape of this opening is selected.

According to FIG. 6, the outer edges 20 of the portions 17 may have notches 21 in the press-in portion 13 in order to further increase the holding forces in the hole 11.

The contact pin 10 is initially produced by forming the portions 17, so they adjoin the outwardly open elongate opening 14 in the manner of fork prongs. The portions 17 are then bent together. They can then be connected to one another, preferably at their ends 17*a*, enclosing the elongate opening 14 or else rest freely against one another. This connection can take place mechanically or by welding. The portions can be formed in any manner, preferably by punching, cold extrusion or cold deformation. The portions 17 are preferably connected directly after the forming, i.e., for example, during the punching process, by welding or laser welding, or substantially in one work operation or manufacturing step. The portions 17 may additionally be provided with an embossing 19 or notches 21.

It is obvious that this description can be subject to the most varied modifications, changes and adaptations which are in the range of equivalents to the accompanying claims.

| List of reference numerals | |
|---|---|
| 10 | contact pin |
| 11 | hole |
| 12 | printed circuit board |
| 13 | press-in portion |
| 14 | elongate opening |
| 15 | contact legs |
| 16 | introduction portion |

-continued

| List of reference numerals | |
|---|---|
| 17 | portion |
| 17a | end |
| 18 | formation |
| 19 | embossing |
| 20 | outer edge of 17 |
| 21 | notch |

The invention claimed is:

1. A contact pin, comprising a contact region and a connection region, wherein the contact pin is produced from a material by a forming process for pressing into a through-connected hole of a printed circuit board, wherein a press-in portion of the contact pin has at least two contact legs, which are spaced apart from one another by at least one elongate opening, are outwardly curved in a central region and come to rest on a wall of the hole when pressed into the hole of the printed circuit board with plastic deformation, wherein at least one introduction portion, for introduction into the hole, is formed by at least two elongate portions, which rest against one another during introduction, of the contact pin, wherein the elongate portions, after the deformation process and before the introduction into the hole, adjoin the outwardly open elongate opening in the manner of fork prongs, wherein at least one formation projecting into the opening is provided on an edge of the elongate opening to form support regions in a region which, after introduction of the contact pin into the hole, is located inside the hole of the printed circuit board.

2. The contact pin according to claim 1 wherein the elongate portions are bent together at their ends.

3. The contact pin according to claim 1, wherein the elongate portions are connected together at their ends to form the pin and enclose the elongate opening.

4. The contact pin according to claim 1, wherein the forming process is at least one process selected from the group of processes consisting of punching, cold extrusion and cold deformation.

5. The contact pin according to claim 1, wherein the elongate portions form the at least two contact legs of the press-in portion and the introduction portion is formed as a pin.

6. The contact pin according to claim 1, wherein the at least one formation is formed by a plurality of substantially inversely symmetrical formations arranged on opposing sides of the elongate opening.

7. The contact pin according to claim 1, wherein the elongate portions have one of an edge- or bead-embossing.

8. The contact pin according to claim 7, wherein the edge- or bead-embossing is a variably extending embossing.

9. The contact pin according to claim 1, wherein a cross-section of the elongate portions increases from the introduction portion to the press-in portion.

10. The contact pin according to claim 1, wherein outer edges, that are directed away from one another, of the elongate portions, which, at least in the region of the introduction portions, are shaped symmetrically with respect to a centre line extending through the elongate opening, are rounded to form an introduction tip.

11. The contact pin according to claim 10, wherein the outer edges of the elongate portions have notches in the press-in portion.

12. A method for producing a contact pin, with a connection region and a contact region by a forming process, wherein the contact pin is pressed into a through-connected hole of a printed circuit board with plastic deformation and wherein the contact pin has a press-in portion with at least two contact legs which are spaced apart from one another by an elongate opening and are outwardly curved in their central region, and an introduction portion with at least two elongate portions which rest against one another during introduction, wherein the at least two elongate portions are shaped during the forming process and before introduction into the hole in such a way that they adjoin the outwardly open elongate opening in the manner of fork prongs, wherein at least one formation projecting into the opening is placed at an edge of the elongate opening to form support regions in a region which, after introduction of the contact pin, is located inside the hole of the printed circuit board.

13. The method according to claim 12, wherein the elongate portions are bent together at their ends.

14. The method according to claim 12, wherein the contact pin is punched, cold extruded or cold deformed during the forming process.

15. The method according to claim 12, wherein, in the forming process, production of the elongate opening with the formation and connection of the elongate portions take place directly one after the other in one manufacturing step.

16. The method according to claim 12, wherein the portions are provided with an embossing.

17. The method according to claim 12, wherein, in the forming process, notches are produced on outer edges of the elongate portions.

18. The contact pin according to claim 1, wherein the elongate portions are free at their ends.

* * * * *